US008833220B1

(12) United States Patent
Powers, II

(10) Patent No.: US 8,833,220 B1
(45) Date of Patent: Sep. 16, 2014

(54) KNIFE ASSEMBLY FOR A TRIMMING MACHINE

(76) Inventor: Woodrow A. Powers, II, Johnsburg, IL (US)

( * ) Notice: Subject to any disclaimer, the term of this patent is extended or adjusted under 35 U.S.C. 154(b) by 758 days.

(21) Appl. No.: 12/560,450

(22) Filed: Sep. 16, 2009

(51) Int. Cl.
*B26D 1/06* (2006.01)
*B26D 1/09* (2006.01)

(52) U.S. Cl.
USPC ..... 83/697; 83/622; 83/694; 83/862; 83/934

(58) Field of Classification Search
USPC ..... 83/622, 934, 694, 697, 49, 636, 693, 83/862, 933
See application file for complete search history.

(56) References Cited

U.S. PATENT DOCUMENTS

| | | | | | |
|---|---|---|---|---|---|
| 1,519,983 | A * | 12/1924 | Robbins | ..... | 83/622 |
| 2,361,288 | A | 10/1944 | Hardy, Jr. | | |
| 3,074,304 | A | 1/1963 | Cole | | |
| 3,240,094 | A * | 3/1966 | Van Endert | ..... | 83/636 |
| 3,340,758 | A * | 9/1967 | Peterson et al. | ..... | 83/697 |
| 3,922,942 | A * | 12/1975 | Fawcett et al. | ..... | 83/620 |
| 4,653,373 | A | 3/1987 | Gerber | | |
| 5,934,166 | A * | 8/1999 | Herlihy | ..... | 83/605 |
| 2004/0020340 | A1 * | 2/2004 | Burke et al. | ..... | 83/613 |

FOREIGN PATENT DOCUMENTS

| | | |
|---|---|---|
| DE | 246029 | 4/1912 |
| DE | 10325378 | 2/2004 |

OTHER PUBLICATIONS

International Search Report for corresponding International App. No. PCT/US2010/048073, dated Dec. 23, 2010.
International Preliminary Report on Patentability for International App. No. PCT/US2010/048073, issued Mar. 20, 2012.

* cited by examiner

*Primary Examiner* — Clark F. Dexter
(74) *Attorney, Agent, or Firm* — McDonnell Boehnen Hulbert & Berghoff LLP

(57) ABSTRACT

A knife assembly for attachment to an industrial paper trimming or cutting machine having a primary blade and a backbone blade where the cutting edge of the backbone blade is offset at an angle α from the cutting edge of the primary blade. The knife assembly is removably attached to a cutting machine configured to move in a reciprocating motion to trim edges from soft bound single paper products.

8 Claims, 2 Drawing Sheets

KNIFE ASSEMBLY FOR A TRIMMING MACHINE

FIELD OF THE PRESENT INVENTION

This invention relates to an improved knife assembly for use on a trimming or cutting machine to trim single, multi-page paper products, for example soft covers books or periodicals. Specifically, my invention is an assembly of at least two pieces, a primary blade and a backbone blade, that allows for score cutting a paper product binding or backbone to produce a cleaner cut. My improved knife assembly can be custom configured for retrofitting to O.E.M. trimming machines.

BACKGROUND OF THE INVENTION

Non-rotary cutting single edged knifes for trimming paper products are known. These prior art knives are single edged and are typically affixed to industrial cutting machines that operate in a reciprocating fashion. A draw back of these single edged knives is that they cause damage to soft cover bindings when trimmed. This damage typically manifests itself as small areas of backbone chipping/tearing that greatly diminishes the quality of the binding, which can ruin the visual appearance of the finished product. Prior art backbone trimming knives dull quickly and require multiple change outs resulting in production loss time of from 30 to 60 minutes. With typical machinery producing anywhere between 8,000 to 30,000 books per hour, frequent change outs are very costly.

Accordingly, there exists a strong need to provide an improved knife design that avoids damage to the binding, provides a clean visually appealing trimmed edge, and maintains its cutting edge, thus avoiding costly frequent change outs. The present invention achieves this goal and overcomes the above-mentioned problems by providing a combination of a primary blade with at least one beveled edge backbone blade where the cutting edge is offset from (i.e. angled relative to) the primary cutting edge.

These and other advantages of the invention will become evident from the following more detailed description of the invention.

SUMMARY

My invention substantially reduces the damage caused by conventional single cutting edge reciprocating knifes. The instant invention includes a knife assembly for removable attachment to an industrial cutting or trimming machine that includes a primary blade and at least one removable beveled backbone blade, each with a separate cutting edge. The primary blade has two sides where one side contains a beveled portion having a height BEH terminating in a sharp cutting edge. The primary blade is defined by a length L and a height H, preferably where the length L is in the range from about 6 inches to about 36 inches and the height H is in the range from about 2 inches to about 24 inches. The height BEH can be in the range from about 0.5 inches to about 2 inches, most preferably 0.75 inches to 1.25 inches. The primary blade preferably is fabricated from carbon steel, D-2, high speed steel, carbide inlaid material, ceramics and other similar hardened materials. The angle of the beveled edge on at least one side of the primary blade is preferably in the range from about 10 degrees to about 40 degrees, most preferably from 22 to 30 degrees.

The backbone blade is configured for attachment to the primary blade, preferably through a removable fastener to facilitate maintenance or replacement of either blade. The backbone blade has a width W and can be fabricated from the same or different materials of construction as the primary blade, however, a preferred material of construction is carbon steel, D-2, high speed steel, or carbide inlaid material. At least one side of the backbone blade has a beveled edge of a width BBW, preferably in the range of from about 0.5 inches to about 2.0 inches, most preferably 0.75 inches to 1.25 inches, terminating in a backbone cutting edge that is in the same vertical plane as the cutting edge of the primary blade. The width W of the backbone blade preferably is in the range of from about 3 inches to about 10 inches. The angle of the beveled edge of the backbone blade can be the same as or different that the beveled edge of the primary blade, but in any instance is preferably in the range from about 10 degrees to about 40 degrees, most preferably from 22 to 30 degrees.

When attached to the primary blade a portion of the backbone cutting edge extends below the primary cutting edge and is offset from (i.e., angled relative to) the primary cutting edge by an angle $\alpha$. Preferably, angle $\alpha$ is greater than 90 degrees, most preferably at least 135 degrees as measured from the primary blade cutting edge to the backbone cutting edge. As mentioned, the backbone cutting edge is preferably in the same plane as the cutting edge of the primary blade.

In one preferred configuration of the knife assembly of the invention, L is at least twice H, BEH is greater than BBW, W is less than H, and the primary blade has a non-beveled side opposite the primary beveled side. Additionally, the non-beveled side contains a slot configured to accept a portion of the backbone blade. The backbone blade can be attached to the slot in any manner that securely holds it in place during cutting or trimming, preferably the backbone blade is secured with one or more bolts, screws, rivets, pins, or the like fasteners. Alternatively, an adhesive, such as an epoxy, can be used alone or in combination with the above-mentioned fasteners. In situations where the primary and backbone blades have only one beveled edge, the slot is preferably configured to accept the backbone blade such that the two non-beveled sides of the primary blade and backbone blade are flush with each other.

The primary blade has a plurality of attachment features that can be used with appropriate fasteners to removably connect the knife assembly to a cutting machine. These features may be holes, slots, grooves, or other attachment means that are configured to align and cooperate with similar means or fasteners located on the cutting machine. Preferably, when attached to a cutting machine the knife assembly is operated in a reciprocal manner, as opposed to a rotary manner. In other words, the cutting machine causes the knife assembly to move in an "up and down" cutting motion, as opposed to a rotational direction like that of an electric table or radial arm saw blade.

These as well as other advantages of various aspects of the present invention will become apparent to those of ordinary skill in the art by reading the following detailed description, with appropriate reference to the accompanying drawings.

BRIEF DESCRIPTION OF THE DRAWINGS

Exemplary embodiments are described herein with reference to the drawings, in which.

DETAILED DESCRIPTION OF THE DRAWINGS

Figure 1:
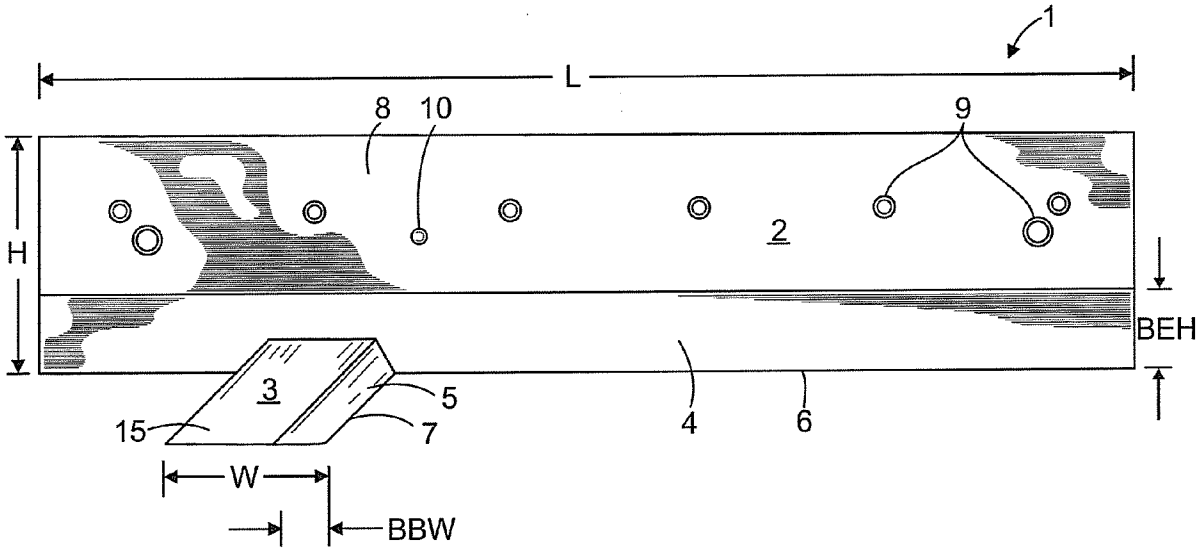
FIG. 1 illustrates a side view of the knife assembly of the invention showing the beveled edge sides of the primary blade and backbone blade.

One possible configuration of the knife assembly 1 of the present invention is shown in the accompanying figures where both the primary blade 2 and the backbone blade 3 have one side that is beveled. FIG. 1 shows a side view of the beveled side 8 of primary blade 2. Backbone blade 3 is attached to the primary blade 2 by machine screw 10. The backbone blade is positioned in slot 13 (see FIG. 3) such that its beveled side 15 is facing the same as the beveled side 8 of the primary blade. This positioning causes the primary cutting edge 6 to be in the same plane as cutting edge 7 of the backbone blade 3. The primary blade 2 has a height H and a length L, with a beveled edge 4 of a height BEH. In the embodiment shown in the figures, L>H>BEH. The backbone blade 3 has a width W and a beveled edged 5 of a width BBW. In the embodiment shown, W>BBW, BEH>BBW, and L>H>W. Although the two cutting edges 6 and 7 are in the same plane, the backbone blade cutting edge 7 is offset from (i.e., angled relative to) the primary blade cutting edge 6 by an angle α (see FIG. 2). Preferably this angle is greater than 90 degrees, most preferably approximately 135 degrees. This figure also illustrates a plurality of fastener means 9 including attachment features of the primary blade 2 that are employed to secure the knife assembly to a cutting machine (not shown).

Figure 2:
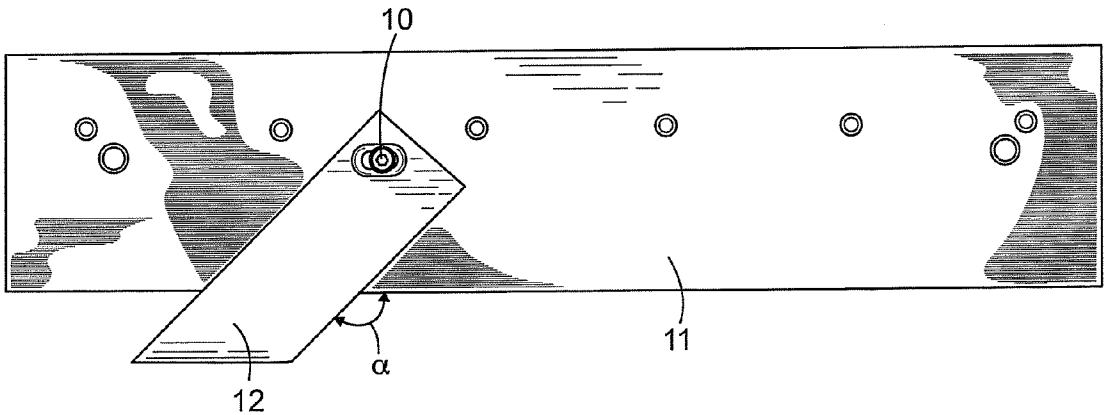
FIG. 2 illustrates a side view of the knife assembly of the invention showing the opposite side of the beveled edge sides of the primary blade and backbone blade, i.e. the non-beveled sides.
Figure 3:
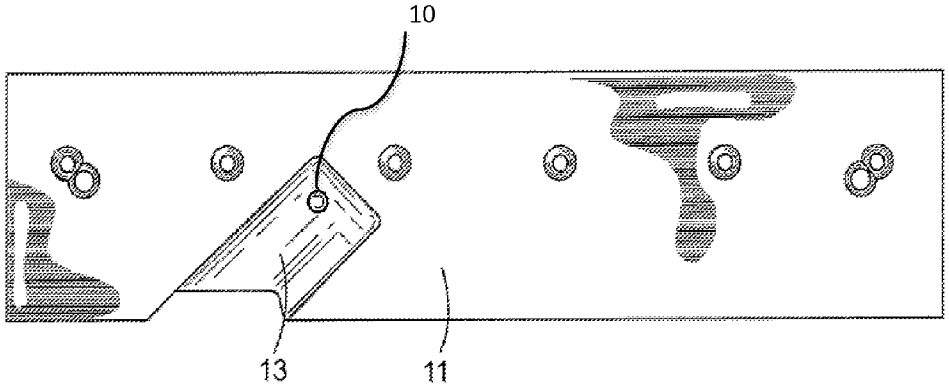
FIG. 3 illustrates a side view of the non-beveled edge side of the primary blade only and the slot configured to accept the backbone blade.
Figure 4:
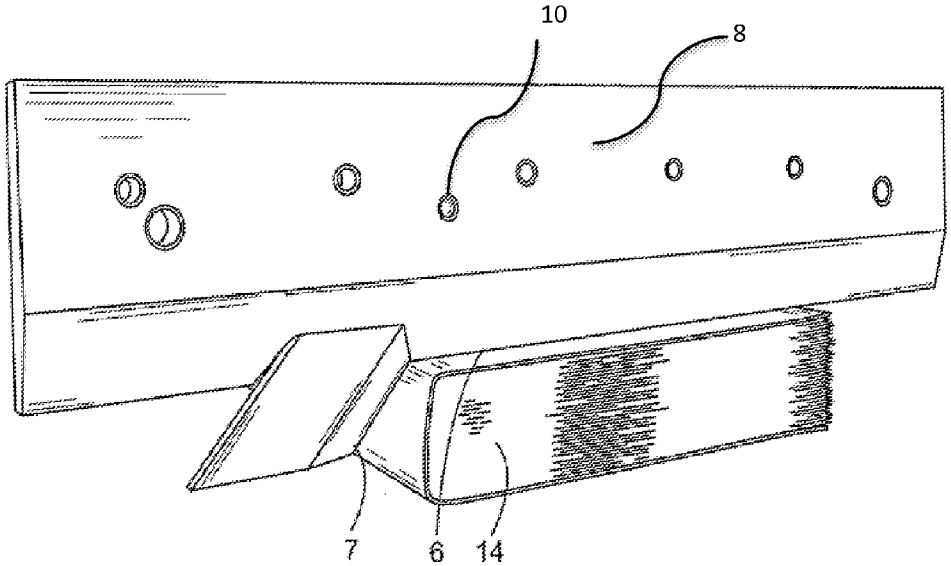
FIG. 4 illustrates a perspective view of the knife assembly of the invention showing the beveled edge sides of the primary blade and backbone blade in a position to trim a paper product.

FIGS. 2 and 3 show the non-beveled sides 11 and 12 of the primary and backbone blades and the positioning of slot 13. FIG. 2 also shows that the slot can be configured such that the non-beveled sides of the two blades are preferably flush with each other. FIG. 4 exemplifies the position of a bound book 14 in contact with cutting edges 6 and 7 immediately before trimming.

Exemplary embodiments of the present invention have been described. Those skilled in the art will understand, however, that changes and modifications may be made to these embodiments without departing from the true scope and spirit of the present invention, which is defined by the claims.

I claim:

1. A knife assembly for a trimming or cutting machine comprising:

a. a primary blade having a primary beveled side of a length L and a height H, a primary beveled edge of a height BEH, and a primary cutting edge, where the primary blade has a non-beveled side opposite the primary beveled side and contains a slot; and b. a backbone blade positioned in the slot and connected to the primary blade, where the backbone blade is of a width W and has a backbone beveled side, a backbone beveled edge of a width BBW, and a backbone cutting edge that lies in the same plane as the primary cutting edge, wherein a portion of the backbone cutting edge extends below the primary cutting edge and is offset from the primary cutting edge by an obtuse angle α that is at least 135 degrees and wherein the backbone blade is positioned in the slot such that a side of the backbone blade that is opposite of the backbone beveled side is flush with the non-beveled side of the primary blade; and wherein the slot intersects the primary beveled edge such that a portion of the primary cutting edge equal to the width W of the backbone blade is missing, the widths W and BBW of the backbone blade each being measured in the knife assembly in a direction that is parallel to the primary cutting edge.

2. The knife assembly of claim 1 where L is at least twice H.

3. The knife assembly of claim 1 where BEH is greater than BBW.

4. The knife assembly of claim 1 where W is less than H.

5. The knife assembly of claim 1 where the primary blade has a plurality of attachment features for removably connecting the assembly to a cutting machine.

6. The knife assembly of claim 1 where the backbone blade is positioned in the slot and removably attached to the primary blade with a removable fastener.

7. A knife assembly for a trimming or cutting machine comprising:

a. a primary blade having a primary beveled side and a primary cutting edge, where the primary blade has a non-beveled side opposite the primary beveled side and contains a slot; and b. a backbone blade attached in the slot, where the backbone blade is of a width W and has a backbone beveled side and a backbone cutting edge, wherein the backbone cutting edge:

i) lies in the same plane as the primary cutting edge, ii) extends below and is offset from the primary cutting edge, and iii) is positioned in the slot such that a side of the backbone blade that is opposite of the backbone beveled side is flush with the non-beveled side of the primary blade, and wherein the slot intersects the primary beveled edge such that a portion of the primary cutting edge equal to the width W of the backbone blade is missing, the width W of the backbone blade being measured in the knife assembly in a direction that is parallel to the primary cutting edge.

8. The knife assembly of claim 7 where the backbone blade and the slot are configured such that the backbone blade can be removably attached to the primary blade using removable fasteners.

* * * * *